United States Patent [19]

Cosenza

[11] Patent Number: 4,512,683

[45] Date of Patent: Apr. 23, 1985

[54] PILING PROTECTOR

[76] Inventor: Marino Cosenza, 351 Poplar Ave., Linwood, N.J. 08221

[21] Appl. No.: 533,655

[22] Filed: Sep. 19, 1983

[51] Int. Cl.[3] ..... E02D 5/60

[52] U.S. Cl. ..... 405/216; 405/211

[58] Field of Search ..... 405/211, 216, 61, 212, 405/213, 217; 114/219, 220

[56] References Cited

U.S. PATENT DOCUMENTS

| | | | |
|---|---|---|---|
| 934,176 | 9/1909 | Hubbard | 405/216 |
| 3,170,299 | 2/1965 | Clarke | 405/61 |
| 3,370,432 | 2/1968 | Butler et al. | 405/216 |
| 3,541,800 | 11/1970 | Walker et al. | 405/211 |
| 4,072,022 | 2/1978 | Shimizu | 405/216 |
| 4,102,144 | 7/1978 | Anders | 405/211 |
| 4,411,556 | 10/1983 | Leblanc et al. | 405/211 X |

FOREIGN PATENT DOCUMENTS

| | | | |
|---|---|---|---|
| 293922 | 1/1971 | U.S.S.R. | 405/211 |

*Primary Examiner*—Dennis L. Taylor
*Attorney, Agent, or Firm*—Duffield & Lehrer

[57] ABSTRACT

A sleeve adapted to float in water and to surround a piling to protect the same from being lifted by ice includes an outer corrugated casing which can be easily gripped by ice forming therearound. Within the casing is a layer of waterproof cementitious material followed by a layer of closed cell foam plastic. The innermost surface of the sleeve, which faces the piling, is a smooth even layer of polyethylene film. Should ice form in the annular space between the piling and the sleeve, the sleeve can easily slide up or down across the outer surface of the ice without moving the piling.

6 Claims, 3 Drawing Figures

PILING PROTECTOR

BACKGROUND OF THE INVENTION

The present invention is directed toward a device for protecting pilings and similar structures mounted in water from damage due to ice uplift.

As is well known in the art, severe damage can be caused to docks and similar structures as a result of the uplifting of the support piles in the winter months. This results from the ice which forms near the upper surface of the water and which surrouds the pilings and becomes tightly affixed thereto. As the tide rises, the ice mass that has formed around the piling rises carrying the piling upwardly therewith. It is not uncommon for the pilings to be moved several feet and the same can actually be removed from the hole into which it had been supported. This movement and dislodgment of the pilings has the even more significant consequence of seriously damaging the docks and other structures which are being supported causing expensive and time-consuming annual repairs.

Attempts have been made in the past to prevent such uplifting of pilings. For example, U.S. Pat. Nos. 4,114,388 and 4,252,471 show frusto-conically shaped guard members which are intended to be securely fastened to the pilings at the water level. Should ice form around the guard member and then be moved upwardly by the rising tides, the ice should simply slide upwardly across the guard member in view of the reduced diameter thereof.

Such devices should, theoretically, provide some protection. However, since they must be permanently secured to the pilings, they are relatively expensive to install. Furthermore, in the event that the relatively thin outer wall of the guard member ever becomes deformed or if a hole should ever be formed therein, ice could securely fasten itself thereto and not slide off of the guard member as intended. Such deformation of the guard member is not unlikely since the same can be easily hit by boats or the like.

Other devices for preventing uplifting of pilings have also been proposed. For example, the devices shown in U.S. Pat. Nos. 3,170,299 and 3,370,432 are sleeves which have an inner diameter slightly greater than the outer diameter of the pilings and which are intended to surround the same. The sleeves are buoyant and move up and down with the water line as the tide rises and lowers.

Each of these two patents includes means for preventing ice from forming in the annular gap between the sleeve and the piling. There is, however, no assurance that such result can be obtained. Furthermore, the device shown in U.S. Pat. No. 3,370,432 must be frequently checked to ensure the proper amount of anti-freeze which is placed in the annular gap.

Another prior art device which is structurally somewhat similar to the device shown in U.S. Pat. No. 3,370,432 is illustrated in U.S. Pat. No. 934,176. This patent is also directed toward a sleeve which surrounds a piling and includes an annular gap. The device is not specifically intended to prevent movement due to ice uplifting but, rather, includes a preservative solution in the annular gap so that as the tide rises and lowers, the solution is constantly applied to the piling.

SUMMARY OF THE INVENTION

The present invention is directed toward a piling protector which is intended to prevent damage due to ice uplifting, which is believed to function better than any prior device and which requires substantially no maintenance once installed. The protecting sleeve of the present invention includes an outer corrugated casing which can be easily gripped by ice forming thereround. Within the casing is a layer of waterproof cement or grout mix followed by a layer of closed cell foam plastic. The innermost surface of the sleeve, which faces the piling, is a smooth even layer of polyethylene film. Should ice form in the annular space between the piling and the sleeve, the sleeve can easily slide up or down across the outer surface of the ice without moving the piling.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
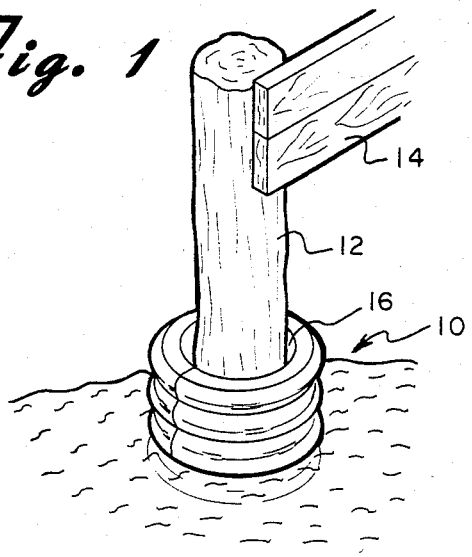
FIG. 1 is a perspective view of the upper portion of a piling protector constructed in accordance with the principles of the present invention and shown in place around a piling.

Referring now to the drawiing in detail wherein like reference numerals have been used throughout the various figures to designate like elements, there is shown in FIG. 1 a piling protector constructed in accordance with the principles of the present invention and designated generally as 10. The protector 10 is shown surrounding a piling 12 which is supporting a portion of a dock or the like 14. A substantially annular space 16 remains between the inner surface of the sleeve 10 and the outer surface of the piling 12.

Figure 2:
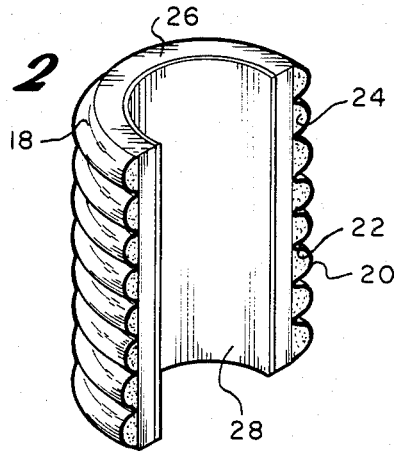
FIG. 2 is a perspective view of one-half of the device shown in FIG. 1.

The sleeve member 10 is substantially tubularly shaped. However, the same is preferably formed in two substantially identical halves, one of which is shown in FIG. 2. It should be understood that the second half is substantially identical. The two halves are clamped together around a piling 12 utilizing straps, buckles or any other conventional fastening means.

As shown most clearly in FIG. 2, the sleeve member 10 includes an outer polyethylene casing 18 which is preferably corrugated but which may have other similar uneven surfaces. As shown, the outer surface of the casing 18 has a plurality of raised portions 20 and a plurality of valleys 22.

The casing 18 can function as a mold into which is poured a waterproof cementitious material such as cement or grout mix 24. Alternatively, the layer of material 24 can be separately formed and merely inserted into the casing 18. The cement or grout material results in a layer which is rigid and solid and provides maximum strength, ballast and durability.

Located on the inside of the layer 24 is a one inch layer of a closed cell foam plastic material 26. Affixed to the inner surface of the foam 26 is a one-sixteenth inch inner polyethylene sheet 28. The polyethylene sheet protects the foam from harmful marine growth on the piling and provides an "oily" surface for the ice to slip as will be described in more detail below.

The average density of the sleeve member 10 which includes the cementitious and plastic materials is slightly less than the density of water. As a result, the device will float in water with the largest portion thereof below the water level and only a small portion extending upwardly above the level of the water. The diameter of the sleeve member will, of course, be chosen so as to fit around the piling 12. The height of the same may vary depending on the climate in which thee devices are intended to be used. In relatively warm climates where ice of only a couple of inches thick may form, a relatively short sleeve is needed. In colder climates, it may be necessary to construct the sleeves to be several feet long. In the preferred embodiment, the sleeve is approximately twenty-one inches in length.

Figure 3:
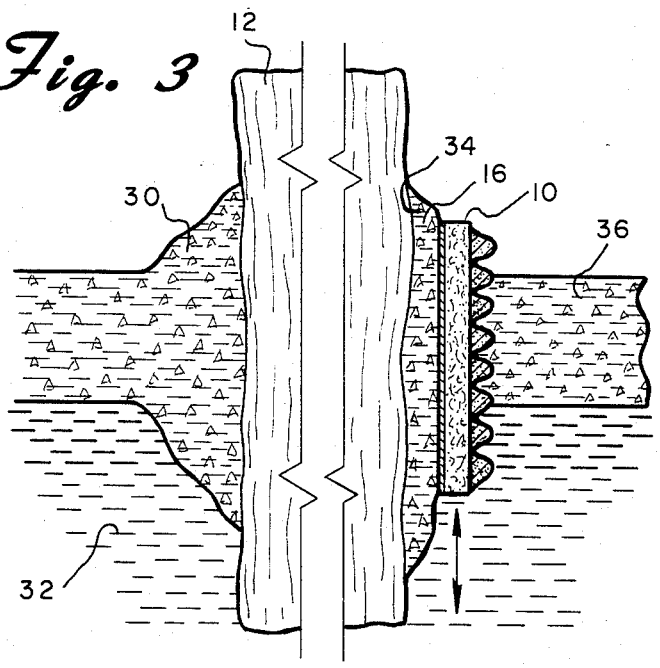
FIG. 3 is a cross-sectional view illustrating the manner in which the piling protector of the present invention functions.

FIG. 3 illustrates the manner in which the piling protector 10 functions to protect the piling 12. The left side of FIG. 3 illustrates a piling which is not protected. The outer surface of the piling 12 is relatively uneven and may have numerous small holes and crevices therein since the same are normally natural wood. As a result, the ice 30 which may form on the upper surface of the water 32 tightly grips the piling. As the tide rises and the water level moves up, the ice 30 is also moved upwardly pulling the piling along with it.

When a sleeve member is in place, as shown on the right side of FIG. 3, the sleeve does not prevent ice 34 from forming on the piling in the annular gap 16 between the inner surface 28 of the sleeve and the piling 12. Ice, of course, also would form on the outer surface of the casing 18 as shown at 36. The ice 34 is, however, separated from the ice 36 by the sleeve 10.

Because of the uneven outer surface of the casing 18, the ice 36 which forms around the sleeve 10 tightly grips the same. As the water level rises, it also forces the sleeve upwardly with the ice 36. However, because of the smooth and even inner surface formed by the polyethylene layer 28, the sleeve slides easily upwardly (or downwardly) against the outer surface of the ice 34. Siince the sleeve 10 slips easily over the ice 34, no upward forces are placed on the piling 12 and the same remains undisturbed.

The present invention may be embodied in other specific forms without departing from the spirit or essential attributes thereof and accordingly, reference should be made to the appended claims rather than to the foregoing specification as indicating the scope of the invention.

I claim:

1. Means for protecting a piling from being lifted by rising ice as the tide rises including:

a substantially tubular sleeve member having a constant and uniform inner diameter greater than the diameter of the piling being protected;

said sleeve member having an outer casing with an uneven surface and a layer of rigid solid material inwardly, said uneven surface having a plurality of raised portions and a plurality of valleys so that ice forming therearound will tightly grip the sleeve member;

the average density of the sleeve member being slightly less than that of water so that the same floats in water with a small portion thereof being above the water level;

the innermost surface of the sleeve member facing said piling being even, continuous and smooth whereby said sleeve member is capable of easily sliding up or down across any ice which may form around said piling and between the piling and the sleeve member.

2. The invention as claimed in claim 1 wherein said rigid material is comprised of a cementitious material.

3. The invention as claimed in claim 2 wherein said rigid material is waterproof.

4. The invention as claimed in claim 2 further including a layer of foam plastic material located between said layer of cementitious material and said innermost surface.

5. The invention as claimed in claim 4 wherein said innermost surface is comprised of a sheet of plastic material.

6. The invention as claimed in claim 5 wherein said sheet of plastic material is comprised of polyethylene.

* * * * *